US007335015B2

(12) United States Patent
Meier

(10) Patent No.: US 7,335,015 B2
(45) Date of Patent: Feb. 26, 2008

(54) METHOD FOR CONTROLLING OR REGULATING A BURNER

(75) Inventor: Alexander Meier, Bühlertal (DE)

(73) Assignee: Siemens Building Technologies AG, Zurich (CH)

( * ) Notice: Subject to any disclaimer, the term of this patent is extended or adjusted under 35 U.S.C. 154(b) by 148 days.

(21) Appl. No.: 10/923,919

(22) Filed: Aug. 23, 2004

(65) Prior Publication Data

US 2005/0048425 A1 Mar. 3, 2005

(30) Foreign Application Priority Data

Aug. 29, 2003 (EP) ..... 03019747

(51) Int. Cl.
*F23M 3/04* (2006.01)
*F23N 1/02* (2006.01)

(52) U.S. Cl. ..... 431/10; 431/12; 431/354

(58) Field of Classification Search ..... 431/12 O, 431/75 X, 10, 354
See application file for complete search history.

(56) References Cited

U.S. PATENT DOCUMENTS 4,586,893 A 5/1986 Somerville et al.
2005/0250061 A1* 11/2005 Lochschmied ..... 431/75

FOREIGN PATENT DOCUMENTS

| | | | |
|---|---|---|---|
| DE | 100 01251 A1 | | 7/2001 |
| EP | 0 124 330 A1 | | 11/1984 |
| EP | 0 644 376 | * | 7/1994 |
| EP | 0 644 376 A1 | | 3/1995 |
| EP | 0 644 376 B1 | | 10/1997 |

* cited by examiner

*Primary Examiner*—Alfred Basichas
(74) *Attorney, Agent, or Firm*—Maginot, Moore & Beck

(57) ABSTRACT

Method for controlling or regulating a burner (5) to which a defined air quantity (3) and fuel quantity (4) are fed, the exhaust gas (6) formed during the combustion being fed to a sensor (7), and the actual value (8) detected by the sensor being compared with a desired value (9), and a control deviation being obtained from the difference between desired value and actual value, which control deviation is converted into a control variable (11) which is independent of the burner power, characterized in that a power-dependent control variable (15) is generated from the power-independent control variable (11) and from burner-specific parameters (13) which are determined during setting of the burner for the respective power points of the burner, and in that the power-dependent control variable (15) is converted into a control signal (17, 18) in order to influence the ratio of the air quantity (3) to the fuel quantity (4).

7 Claims, 2 Drawing Sheets

METHOD FOR CONTROLLING OR REGULATING A BURNER

The invention relates to a method for controlling or regulating a burner in accordance with the preamble of claim 1, and to a system for carrying out the method according to the invention in accordance with claim 7.

Figure 1:
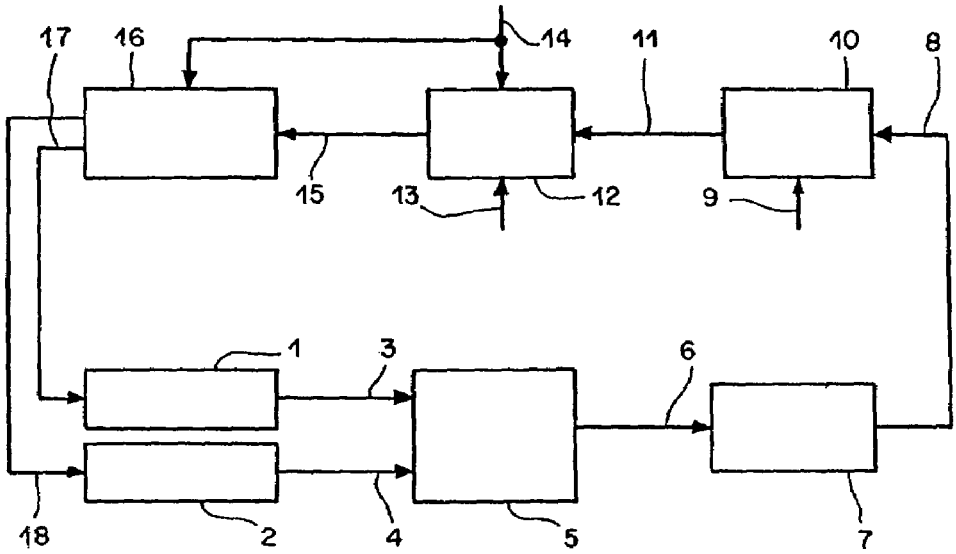

A method of the type described in the introduction is known, for example, from EP 0 644 376 B1. FIG. 1 of this document shows a combustion system having a heating boiler 1, a burner 2, the power of which can be shifted in steps or on a modulated basis. The burner has a fuel feed 4 and an air feed 5, with an actuating element, for example an air flap 6 for matching the supplied air quantity to the supplied fuel quantity, being present in the air feed. The exhaust gases 7 formed during combustion are passed onward via an exhaust-gas duct 3. In the exhaust-gas duct 3 there is a measuring probe 8 which, for example, measures the oxygen content of the exhaust gas. The $O_2$ actual value measured by the measuring probe is fed to a control apparatus 9, where it is compared with a desired $O_2$ value. The air flap 6 is controlled as a function of the difference determined between desired value and actual value in such a way that the oxygen content measured in the exhaust gas (actual $O_2$ value) reaches the desired $O_2$ value which has been set.

Figure 2:
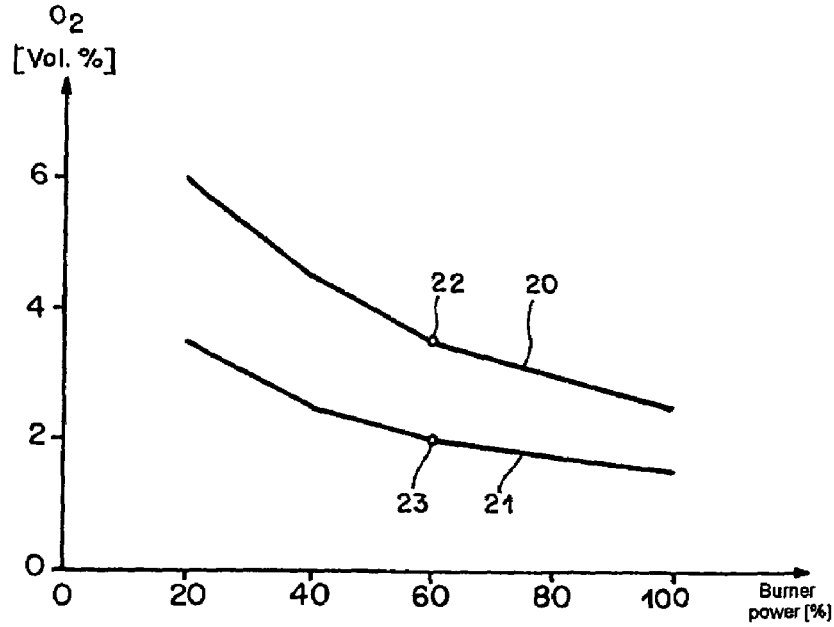

Since the optimum air feed or the optimum air excess for combustion is power-dependent, FIG. 2 diagrammatically depicts the $O_2$ control circuit as a function of the power of the burner. A control deviation 11 results from the difference between the actual $O_2$ value and the desired $O_2$ value and is fed to a controller 12. The controller 12 first of all calculates a power-independent control variable YR from the control deviation 11. The power-independent control variable YR is then converted by a correction element 12*a* into a control variable 13 which is dependent on the power of the burner. This power-dependent control variable 13 is then fed to the air flap 6, the air-flap position 15 of which influences a control section 16. The control parameters are in this case obtained from measurements of step responses at the open-loop control circuit in accordance with FIG. 3. The control parameters determined in this way can in this case be determined and stored for each fuel used and for each power stage of the burner.

In the known method, the relationship between the power-dependent control variable and the power-independent control variable is defined by means of the path gain KS.

However, a precondition for this is that the path gain KS be substantially inversely proportional to the burner power.

Although this approach approximately holds true for a burner which behaves ideally, for example if the power-dependent control variable represents the absolute air quantity and the desired $O_2$ value is identical for all power points, in practice this is rarely the case. Rather, the burners may react to a different extent to a change in air quantity at different power points.

In the known method, the power-dependent control variable is directly applied to an air flap. Consequently, the relationship between air quantity and measured $O_2$ value may not be linear, for example on account of a nonlinear air flap characteristic. However, this is not taken into account in the known method. The known method also has the drawback that in the case of a combustion system with a plurality of air-determining actuators, the power-dependent control variable has to be allocated between these actuators accordingly. However, this is difficult and involves considerable effort.

Therefore, it can be concluded that the known method is of only limited suitability for practical use.

The invention is therefore based on the object of proposing a method for controlling or regulating a burner which is simple and versatile in use yet avoids the abovementioned drawbacks of the prior art.

The object is achieved by the features given in claim 1.

Figure 3:
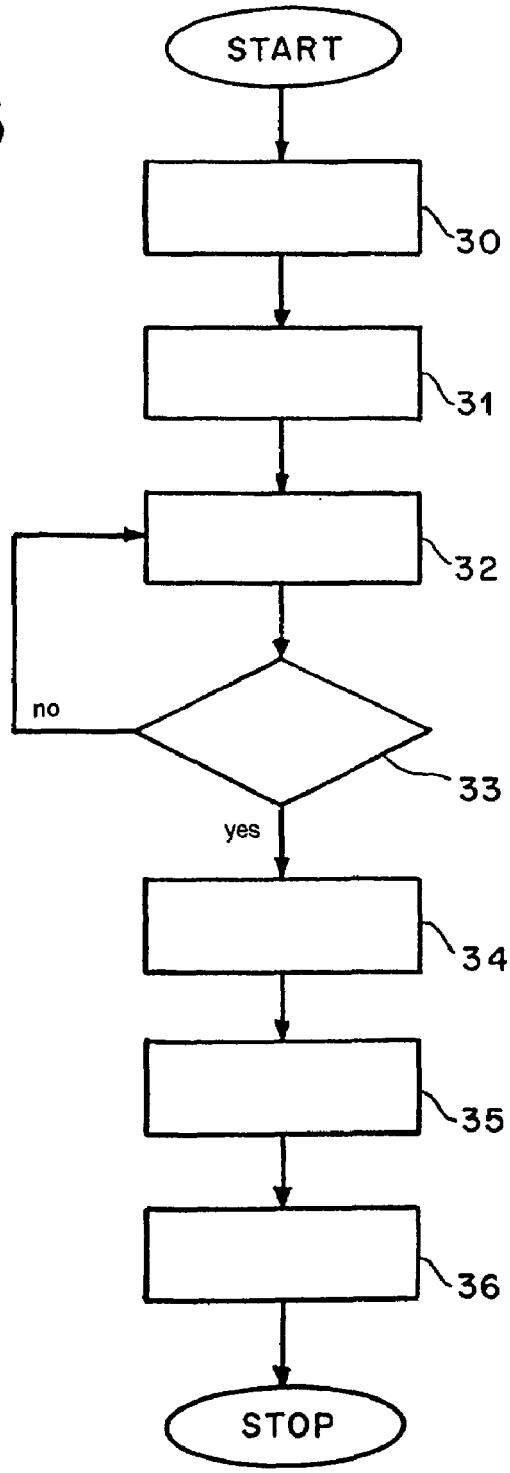

A preferred exemplary embodiment of the invention is explained in more detail below on the basis of the figures, in which:

FIG. 1 shows the control circuit according to the invention in the form of a functional block diagram, FIG. 2 shows a combined curve and a desired value curve, FIG. 3 shows a flow diagram of the method according to the invention.

The control in accordance with the invention is preferably carried out as an $O_2$ control. In this case, actuators 1 and 2, for example air flaps or gas valves, are used to feed a defined air quantity 3 and a defined fuel quantity 4 to the burner 5 in a known way. A sensor 7 detects, for example, the $O_2$ content contained in the exhaust gas 6, which is referred to below as the actual value 8. This represents a current measure of the quality and efficiency of the combustion and is compared with a desired value 9. A control deviation is obtained from the difference between desired value and actual value, and a controller 10 converts this control deviation into a power-independent control variable (YR) 11, which is then fed to a pilot controller 12. For further processing by the pilot controller 12, the latter is fed, for example, with the burner power 14 and if appropriate also the type of fuel used as control information.

The pilot controller also receives burner-specific parameters 13 which characterize the burner-specific and boiler-specific performance of the combustion installation for various working points of the burner when the combustion air quantity changes. These parameters are, for example, determined for various power points of the burner and if appropriate also for different types of fuel during setting of the burner and are stored as characteristic variables.

The pilot controller 12 then determines a power-dependent control variable (Y) 15 on the basis of the power-independent control variable 11 and the burner-specific parameters 13, also taking account of the control information 14. This power-dependent control variable 15 is then converted by an electronic combination controller 16 into a control signal 17 or 18 for at least one of the actuators 1 and 2, which then controls the air quantity 3 or fuel quantity 4 fed to the burner accordingly.

In the exemplary embodiment, the air quantity is controlled by the electronic combination controller as a function of the measured oxygen content in the exhaust gas. In this context, it is preferable simply to reduce the air quantity. This can be done, for example, by reducing the air power on a combination curve, with the result that the characteristics of the air-determining actuators are automatically also taken into account.

Of course, the teaching of the invention is not restricted to influencing the air quantity, but rather it would also be possible for the fuel quantity to be controlled or regulated accordingly as an alternative to the air quantity. Also, the invention can be used not only in conjunction with an $O_2$ measurement, but rather it is also possible to use a $CO_2$ measurement.

The following text describes the control performance when the burner power changes. As soon as a power adjustment occurs, the controller is blocked, so that a delay caused by the transit time of the exhaust gases does not result in an out-of-date actual value being compared with the desired value.

During the power adjustment, the control variable which was generated last by the controller at a steady-state power is maintained and used to calculate the power-dependent control variable. The pilot controller determines the power-dependent control variable, in such a manner that if the ambient conditions remain identical, the controller generates the same, constant power-independent control variable for all burner powers in the stabilized state. It is preferable for the pilot controller also to normalize the power-independent control variable generated by the controller. The normalization is effected, for example, in such a manner that a percentage change in the magnitude of the air density can be compensated for by an identical percentage change in the control variable.

The controller is only enabled again when the actual value is stable and can therefore be measured with sufficient accuracy. This is the case, for example, when the burner once again has a steady-state power and sufficient time has elapsed to ensure that the time delay before the actual value is recorded cannot give rise to a false control deviation and therefore to a control variable which is generated incorrectly by the controller. To prevent the actual value from dropping below the desired value during the power change, control interventions are additionally possible when the controller is blocked. The control interventions may, for example, increase the control variable if the desired value is undershot in such a way that the higher actual value obtained as a result is once again within the permissible range.

This may be required, for example, in the event of inaccurate setting of the burner or in the case of burners with properties which fluctuate considerably with the power.

It is also possible for an offset to be added to the control variable in the event of a power adjustment. As a result, the system moves beyond the desired value during the power adjustment, so that undershooting of the desired value during power adjustment is avoided. When a steady-state power is once again present, the controller is enabled and the system is returned to the desired value.

The control or regulation according to the invention therefore has the advantage that the actual performance of the burner and boiler in response to a change in control variable is reproduced by the burner-specific parameters determined for various working points or power points during setting of the burner. Therefore, under real conditions in practice, the controller only has to be activated in the event of a change in the ambient conditions (air pressure, temperature, etc.).

The way in which the burner-specific parameters are determined is described in more detail below with reference to FIGS. 2 and 3. FIG. 2 diagrammatically depicts a combination curve 20 obtained for various power points of the burner when setting the burner. The fuel and air power are preferably equal on the combination curve. The combination curve 20 and a corresponding desired-value curve 21 represent, for example, the percentage $O_2$ content in the exhaust gas as a function of the burner power. By way of example, a measured value 22 selected from the combination curve 20 and a corresponding desired value 23 on the desired-value curve can be used to determine the burner-specific parameters.

Of course, it is also possible to use other values to determine the burner-specific parameters. By way of example, two measured values and the power-dependent control variable Y required for changing from the first value to the second value with an open-loop control circuit can be used for this purpose. This is advantageous in particular if the system with the combination curve can be set directly to the desired value and just two arbitrary values on the combination curve are required to determine the burner-specific properties.

The combination curve and/or desired-value curve can be determined and stored even for various types of fuel when setting the burner. In this context, it should be ensured that they are linear between the power points, since otherwise the pilot controller will be unable to carry out the determination of the burner-specific parameters correctly. In this context, it should be ensured that the various power points are set at identical ambient conditions (air pressure, air temperature, etc.).

FIG. 3 shows a flow diagram, in which method step 30 first of all represents the selection of the power point or working point on the combination curve and desired-value curve. In method step 31, by way of example, the $O_2$ value on the combination curve is measured and displayed. If this value is stable, the control variable, for example the air power, is changed in method step 32 until the actual value reaches the desired value which has been selected. In method step 33, it is then checked whether the new actual value is stable and corresponds to the desired value. If so, the control variable which was required to reach the desired value is displayed and stored as normalization value in method step 34. The normalization value corresponds, for example, to the relative change in air power and therefore in a first approximation also to the change in air quantity. Then, the burner-specific parameters are determined in method step 35. This is preferably based on the air ratio lambda. By way of example, the measured $O_2$ value on the combination curve can be used to determine a combination lambda value and then a corresponding desired lambda value. A lambda factor for the corresponding power point of the burner can then be determined on the basis of this information and the normalization value. In this context, the lambda factor takes account of the burner-specific and boiler-specific properties of the combustion installation at various working points. This ends the setting method, and it is then possible, in method step 36, to use the power-independent control variable YR and the burner-specific parameters obtained during the setting to determine the power-dependent control variable Y. This is described in more detail below.

To determine the burner-specific parameters, the measured $O_2$ value can be converted into lambda in the following way for various qualities of exhaust gas.

When the $O_2$ value is measured with dry exhaust gas, lambda is obtained as follows:

$$\lambda = 1 + \frac{O_2tr}{O_2L - O_2tr} * \frac{VatrN\ \min}{VLN\ \min} \tag{40}$$

In the case of humid exhaust gas, lambda is obtained as follows:

$$\lambda = 1 + \frac{O_2f}{O_2L - O_2f} * \frac{VafN\ \min}{VLN\ \min} \tag{41}$$

The following abbreviations are used in the above equations:

$\lambda$=air ratio $O_2tr$=$O_2$ content of dry exhaust gas $O_2f$=$O_2$ content of humid exhaust gas $O_2L$=$O_2$ content of ambient air (20.9%)

VLNmin=air quantity for stoichiometric combustion

VatrNmin=dry exhaust gas volume under stoichiometric combustion

VafNmin=humid exhaust gas volume under stoichiometric combustion

The air power is obtained as a function of the control variable Y as follows:

$$\text{Pair} = Pfuel * \frac{Y}{100\,\%} \tag{42}$$

If the air power changes, the resultant new lambda is derived in accordance with the following equation:

$$\lambda' = \lambda * \left(1 + \frac{\Delta air\ [\%]}{100\,\%}\right) \tag{43}$$

On the condition that the relative change in air quantity given in formula (43), with an open-loop control circuit, is proportional to the control variable Y, the relationship between the desired lambda value and the combination lambda value is derived as follows, with the control variable Y corresponding to the normalization value "Norm".

$$\lambda des = \lambda V * \left(1 + \frac{Norm}{100\,\%}\right) \tag{44}$$

Since in practice the relationship between change in air quantity or normalization value and the change in lambda defined in formulae (43) and (44) does not always hold for all burners, a burner-specific lambda factor is introduced. This is determined for each power point and represents the burner-specific and boiler-specific properties of the combustion installation:

$$\lambda des = \lambda V * \left(1 + \frac{Norm * dLB}{100\,\%}\right) \tag{45}$$

The lambda factor is then obtained from formula (45) as follows:

$$dLB = \frac{100\,\% * (\lambda des - \lambda V)}{\lambda V * Norm} \tag{46}$$

If the air density changes, the combination lambda value changes as follows:

$$\lambda V' = \lambda V * \left(1 + \frac{\Delta D\ [\%]}{100\%}\right) \tag{47}$$

Without intervention from the controller, the desired lambda value which is then established is obtained as follows:

$$\lambda des' = \lambda V' * \left(1 + \frac{Norm * dLB}{100\%}\right) \tag{48}$$

In order to return to the original desired lambda value, a different change in air quantity ΔPair, which deviates from the normalization value, is required:

$$\lambda des = \lambda V' * \left(1 + \frac{\Delta Pair * dLB}{100\,\%}\right) \tag{49}$$

The relative change in air power then results in the following way:

$$\Delta Pair = \frac{\frac{\lambda des * 100\%}{\lambda V'} - 100\%}{dLB} \tag{50}$$

The new combination lambda value from equation (47) is used in formula (50), resulting in the control variable Y as follows:

$$\Delta Pair = \frac{\frac{\lambda des * 100\%}{\lambda V * \left(1 + \frac{\Delta D[\%]}{100\%}\right)} - 100\%}{dLB} \tag{51}$$

Since the change in air density given in formula (51) is power-independent, the change in air density can be equated to the power-independent control variable "ctrl", making the latter power-independent. At the same time, it is also possible to normalize the control variable with respect to the corresponding change in air density. Formula (52) below is then adapted as follows:

$$\Delta Pair = \frac{\frac{\lambda des + 100\%}{\lambda V * \left(1 + \frac{ctrl[\%]}{100\%}\right)} - 100\%}{dLB} \tag{52}$$

$$\Delta Pair = \frac{\frac{\lambda des * 100\% * 100\%}{\lambda V * (100\% + ctrl[\%])} - 100\%}{dLB} \tag{53}$$

Then, the power-independent control variable in formula (53) is inverted, so that a positive value means more air power, and the lambda factor in accordance with formula (46) is used, resulting in the power-dependent control variable Y as follows:

$$Y = \Delta Pair = \frac{\frac{\lambda des * 100\% * 100\%}{\lambda V * (100\% - ctrl[\%])} - 100\%}{dLB} = \frac{\frac{\lambda des * 100\% * 100\%}{\lambda V * (100\% - YR[\%])} - 100\%}{\frac{100\% * (\lambda des - \lambda V)}{\lambda V * Norm}} \tag{54}$$

Legend for the symbols used in the formulae:

λV=combination lambda value

λdes=desired lambda value

Norm=normalization value ctrl=YR=power-independent control variable

ΔPair=relative change in air power [%]

dLB=lambda factor

ΔD=change in air density [%]

Y=power-dependent control variable

The invention claimed is:

1. A method for controlling or regulating a burner to which a defined air quantity and fuel quantity are fed, the exhaust gas formed during the combustion being fed to a sensor, and the actual value detected by the sensor being compared with a desired value, and a control deviation being obtained from the difference between desired value and actual value, which control deviation is converted into a control variable which is independent of the burner power, characterized in that a power-dependent control variable is generated from the power-independent control variable and from burner-specific parameters which are determined during setting of the burner for the respective power points of the burner, and in that the power-dependent control variable is converted into a control signal in order to influence the ratio of the air quantity to the fuel quantity, characterized in that the power-independent control variable which was last present at a steady-state burner power is maintained in the event of an adjustment to the burner power and is taken into account when determining the power-dependent control variable, and characterized in that the power-independent control variable is normalized in such a manner that a percentage change in the air density is compensated for by an identical percentage change in the control variable.

2. The method as claimed in claim 1, characterized in that the burner-specific parameters, during setting of the burner, are determined from a first measured value and a second value and a power-dependent control variable required for changing from the first value to the second value.

3. The method as claimed in claim 2, characterized in that a lambda factor is used for the burner-specific parameters.

4. The method as claimed in claim 3, characterized in that the power-dependent control variable represents a change in the air power or fuel power which changes the supplied air quantity or fuel quantity.

5. A system for controlling or regulating a burner, to which a defined air quantity and fuel quantity are fed by means of actuators, the exhaust gas formed during the combustion being fed to a sensor, and the actual value detected by the sensor being compared with a desired value, with a control deviation being obtained from the difference between desired value and actual value, which control deviation is converted by the controller into a control variable which is independent of the burner power, characterized in that a power-dependent control variable is determined by a pilot controller from the power-independent control variable and from burner-specific parameters, and that the power-independent control variable is normalized by the pilot controller in such a manner that a percentage change in the air-density is compensated for by an identical percentage change in the control variable, and in that the power-dependent control variable is fed to an electronic combined controller, which then generates a control signal for at least one actuator in order to influence the ratio of the air quantity to the fuel quantity.

6. A system for controlling or regulating a burner, comprising actuators configured to cause a defined air quantity and fuel quantity to be provided to a burner;

a sensor configured to receive exhaust gas formed during combustion and generate an actual sensed value;

a control circuit configured to compare the actual sensed value with a desired value to obtain a control deviation from the difference between desired value and actual value;

convert the control deviation into a control variable which is independent of the burner power, wherein a power-dependent control variable is determined by a pilot controller from the power-independent control variable and from burner-specific parameters, the power-independent control variable is normalized by the pilot controller in such a maimer that a percentage change in the air-density is compensated for by an identical percentage change in the control variable, and the power-dependent control variable is fed to an electronic combined controller, which then generates a control signal for at least one actuator in order to influence the ratio of the air quantity to the fuel quantity.

7. The system of claim 6, wherein the sensor comprises an oxygen sensor.

* * * * *